US012799703B2

(12) United States Patent
Herrmann et al.

(10) Patent No.: US 12,799,703 B2
(45) Date of Patent: Nov. 17, 2026

(54) TRENCH CUTTER AND METHOD FOR MAKING A CUT TRENCH IN THE GROUND

(71) Applicant: BAUER Maschinen GmbH, Schrobenhausen (DE)

(72) Inventors: Christian Herrmann, Aichach (DE); Sebastian Soier, Schrobenhausen (DE); Thomas Vohs, Gilching (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 27 days.

(21) Appl. No.: 18/843,088

(22) PCT Filed: Feb. 9, 2023

(86) PCT No.: PCT/EP2023/053162

§ 371 (c)(1),
(2) Date: Aug. 30, 2024

(87) PCT Pub. No.: WO2023/165796

PCT Pub. Date: Sep. 7, 2023

(65) Prior Publication Data

US 2025/0179758 A1 Jun. 5, 2025

(30) Foreign Application Priority Data

Mar. 1, 2022 (EP) ..... 22159510

(51) Int. Cl.

| | |
|---|---|
| ***E02F 3/20*** | (2006.01) |
| ***E02D 17/13*** | (2006.01) |
| ***E02F 3/24*** | (2006.01) |

(52) U.S. Cl.

CPC ..... *E02F 3/205* (2013.01); *E02D 17/13* (2013.01); *E02F 3/246* (2013.01); *E02D 2250/003* (2013.01); *E02D 2300/0023* (2013.01)

(58) Field of Classification Search

CPC . E02F 5/106; E02F 5/145; E02F 9/205; E02F 5/14; E02F 5/104; E02F 5/027;

(Continued)

(56) References Cited

U.S. PATENT DOCUMENTS 2,048,710 A * 7/1936 Ranney ..... E21B 7/003 37/351
2,136,911 A * 11/1938 Ernest, V ..... E02F 5/027 37/372

(Continued)

FOREIGN PATENT DOCUMENTS

EP 1452645 A1 9/2004
EP 3296468 A1 3/2018

(Continued)

OTHER PUBLICATIONS

International Search Report issued in PCT/EP2023/053162; mailed Apr. 12, 2023.

(Continued)

*Primary Examiner* — Edwin J Toledo-Duran
(74) *Attorney, Agent, or Firm* — Studebaker Brackett PLLC

(57) ABSTRACT

The invention relates to a trench cutter comprising a box-shaped housing, on the upper face of which a lifting apparatus can be mounted, at least one cutting wheel, which is arranged on a lower face of the housing and can be driven in rotation to remove soil material, wherein cutting teeth are arranged along the outer circumference of the cutting wheel at least one circumferential row, which at least one axial clearance adjoins, and at least one clearing plate, which is arranged to be fixed relative to the housing and engages in the at least one circumferential clearance on the cutting wheel to clear away soil material. According to the invention, it is provided that the at least one clearing plate is mounted on a plate holder so as to be spaced apart from the (Continued)

Figure 1:
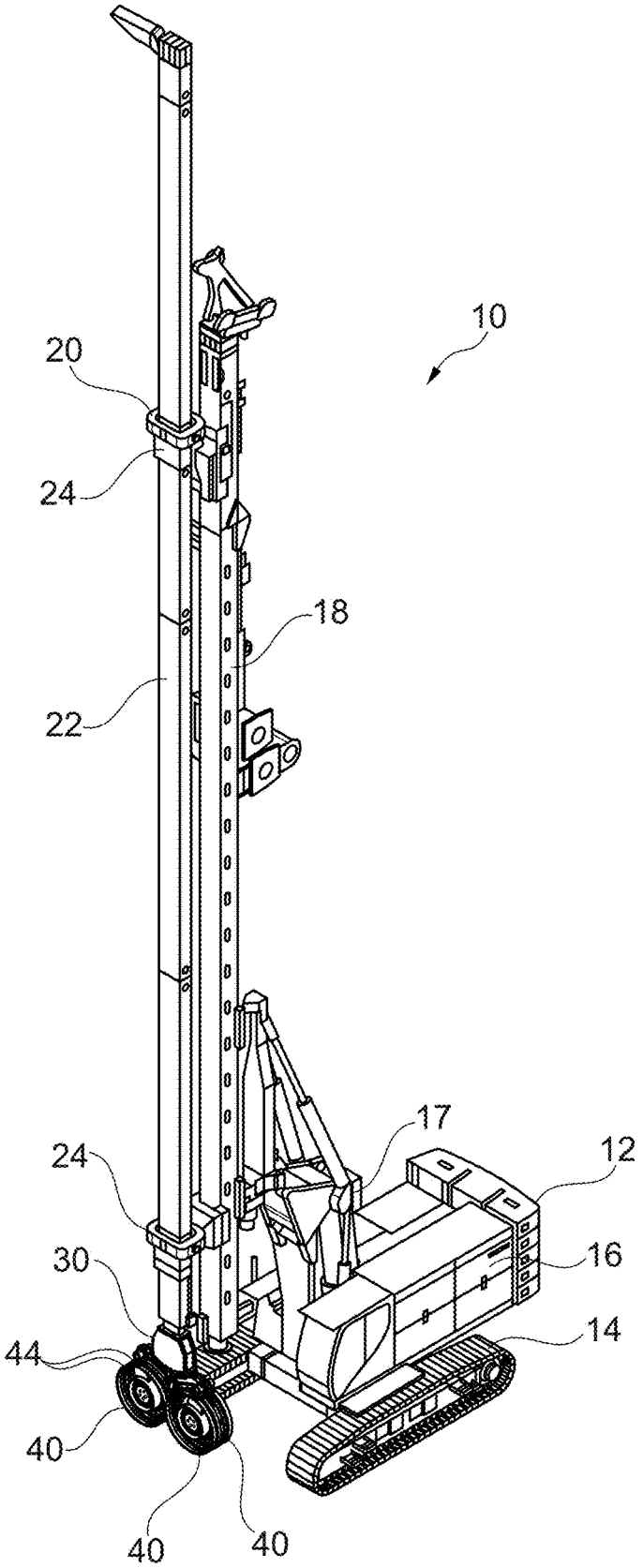

housing, wherein a passage is formed between the at least one clearing plate and the housing, through which passage soil material that has been cut out during operation can be guided upwards.

15 Claims, 5 Drawing Sheets

(58) Field of Classification Search
CPC ..... E02F 5/10; E02F 5/02; E02F 5/102; E02F 3/205; E02F 3/246; E02F 3/248; H02G 1/10; H02G 1/06; B65H 29/52; B65H 31/20; G07D 9/00; E02D 17/13; E02D 2250/003; E02D 2300/0023
See application file for complete search history.

(56) References Cited

U.S. PATENT DOCUMENTS

RE20,990 E * 1/1939 Wright ..... E02F 5/027 37/366
2,849,809 A * 9/1958 Chattin ..... E02F 3/7663 37/372
3,238,734 A * 3/1966 Rhodes ..... E02F 5/107 37/332
3,333,432 A * 8/1967 Hale ..... E02F 5/107 405/164
3,434,297 A * 3/1969 Spollen ..... E02F 5/105 405/160
3,462,963 A * 8/1969 Moore ..... E02F 5/104 405/164
3,504,504 A * 4/1970 Hartwell ..... E02F 5/106 405/163
3,526,047 A * 9/1970 Goltz ..... E02F 9/085 280/43.23
3,590,589 A * 7/1971 Smulders ..... E02F 5/105 405/161
3,627,372 A * 12/1971 Carpenter ..... E02F 3/3681 294/198
3,670,514 A * 6/1972 Breston ..... E02F 5/109 405/160
3,722,224 A * 3/1973 Roy ..... E02F 5/104 405/163
3,751,927 A * 8/1973 Perot, Jr. ..... E02F 5/107 405/162
3,877,237 A * 4/1975 Norman ..... E02F 5/105 405/160
3,897,639 A * 8/1975 Hansen ..... E02F 9/06 37/313
3,990,377 A * 11/1976 Marquinez ..... H04B 5/266 405/161
4,022,028 A * 5/1977 Martin ..... E02F 3/9206 37/330
4,037,422 A * 7/1977 DEBoer ..... E02F 5/107 405/160
4,039,087 A * 8/1977 Sandvick, Sr. ..... F16L 1/09 29/237
4,091,629 A * 5/1978 Gunn ..... E02F 5/104 405/181
4,124,991 A * 11/1978 Adler ..... F16L 1/18 405/166
4,129,992 A * 12/1978 Carlsson ..... E02F 5/106 405/164
4,149,326 A * 4/1979 Rosa ..... E02F 5/108 405/160
4,218,158 A * 8/1980 Tesson ..... F16L 1/26 405/158
4,268,189 A * 5/1981 Good ..... F16L 1/06 405/172
4,268,190 A * 5/1981 Tesson ..... F16L 1/26 405/184.5
4,274,760 A * 6/1981 Norman ..... E02F 5/105 405/160
4,295,757 A * 10/1981 Gaspar ..... E02F 5/107 405/164
4,301,606 A * 11/1981 Hofmeester ..... E02F 5/108 37/329
4,362,436 A * 12/1982 Harmstorf ..... E02F 5/109 405/164
4,410,297 A * 10/1983 Lynch ..... E02F 5/104 405/181
4,465,400 A * 8/1984 Adams ..... F16L 1/161 405/169
4,470,720 A * 9/1984 Lennard ..... E02F 5/108 405/164
4,585,372 A * 4/1986 Grinstead ..... E02F 5/106 405/174
4,586,850 A * 5/1986 Norman ..... E02F 5/105 405/160
4,714,378 A * 12/1987 Lincoln ..... E02F 5/104 405/161
4,714,379 A * 12/1987 Gilchrist, Jr. ..... E02F 5/06 405/166
4,721,409 A * 1/1988 Harmstorf ..... E02F 3/10 405/163
4,749,308 A * 6/1988 Izawa ..... E02F 3/8858 405/161
4,802,793 A * 2/1989 Grinsted ..... H02G 1/10 405/164
4,812,079 A * 3/1989 Johnson ..... E02F 5/104 405/164
4,877,355 A * 10/1989 Van Pelt ..... E02F 5/107 405/158
4,896,998 A * 1/1990 Reece ..... F16L 1/12 405/160
4,992,000 A * 2/1991 Doleshal ..... E02F 5/108 405/164
5,349,765 A * 9/1994 Kitanaka ..... E02F 3/142 37/356
5,626,438 A * 5/1997 Etheridge ..... E02F 5/104 15/104.04
5,659,983 A * 8/1997 Coutarel ..... E02F 5/12 405/163
5,722,793 A * 3/1998 Peterson ..... B63B 35/06 405/164
5,795,101 A * 8/1998 Bill ..... F16L 1/06 405/184.5
6,189,244 B1 * 2/2001 Johnson ..... E02F 5/14 405/181
6,273,642 B1 * 8/2001 Anderson ..... E02F 5/105 405/163
6,435,772 B1 * 8/2002 Reece ..... H02G 1/06 405/164
6,705,029 B2 * 3/2004 Anderson ..... E02F 5/14 405/160
6,719,494 B1 * 4/2004 Machin ..... E02F 5/107 405/160
6,837,653 B1 * 1/2005 Grinsted ..... E02F 5/145 405/164
9,605,407 B2 * 3/2017 Penner ..... E02F 5/027
10,711,432 B2 * 7/2020 White ..... E02F 5/106
11,466,425 B2 * 10/2022 Alumbaugh ..... A01B 31/00
11,613,870 B2 * 3/2023 Walker ..... E02F 5/105 405/159
2002/0017041 A1 * 2/2002 Gloppen ..... E02F 5/006 37/344
2003/0201011 A1 * 10/2003 Beals ..... F16K 7/06 137/15.08
2007/0253780 A1 * 11/2007 Pihl ..... E02F 5/109 405/184
2010/0095560 A1 * 4/2010 Grinsted ..... E02F 5/104 37/352
2011/0211913 A1 * 9/2011 Lazzarin ..... E02F 5/109 405/163
2012/0114420 A1 * 5/2012 Lazzarin ..... F16L 1/163 405/171
2013/0115006 A1 * 5/2013 Oldervoll ..... E02F 5/109 405/160

(56) References Cited

U.S. PATENT DOCUMENTS

| | | | | |
|---|---|---|---|---|
| 2014/0150303 | A1* | 6/2014 | Wilson | E02F 5/125 37/342 |
| 2014/0154014 | A1* | 6/2014 | Wilson | E02F 5/106 172/430 |
| 2014/0283421 | A1* | 9/2014 | Manchester | E02F 5/109 37/309 |
| 2014/0345171 | A1* | 11/2014 | Manchester | E02F 3/088 37/352 |
| 2015/0110563 | A1* | 4/2015 | Manchester | B66C 3/20 405/184.4 |
| 2016/0215476 | A1* | 7/2016 | Walker | E21B 41/04 |
| 2018/0216314 | A1* | 8/2018 | Bonel | E02F 5/145 |
| 2020/0165796 | A1* | 5/2020 | Manchester | E02F 3/9218 |
| 2020/0318314 | A1* | 10/2020 | Lu | E02F 5/107 |
| 2021/0010230 | A1* | 1/2021 | Haddorp | E02F 3/8858 |
| 2021/0095435 | A1 | 4/2021 | Domanski et al. | |
| 2021/0292995 | A1* | 9/2021 | Walker | E02F 5/08 |
| 2022/0352699 | A1* | 11/2022 | Walker | H02G 1/10 |
| 2022/0381004 | A1* | 12/2022 | Manchester | E02F 5/106 |
| 2022/0412046 | A1* | 12/2022 | White | H02G 1/10 |

FOREIGN PATENT DOCUMENTS

| | | | | |
|---|---|---|---|---|
| EP | 3543408 | A1 | 9/2019 | |
| EP | 3543408 | B1 * | 10/2020 | E02F 3/961 |

OTHER PUBLICATIONS

International Preliminary Report On Patentability and Written Opinion issued in PCT/EP2023/053162; issued Aug. 30, 2024.

* cited by examiner

TRENCH CUTTER AND METHOD FOR MAKING A CUT TRENCH IN THE GROUND

The invention relates to a trench cutter comprising a box-shaped housing, on the upper face of which a lifting apparatus can be mounted, at least one cutting wheel, which is arranged on a lower face of the housing and can be driven in rotation to remove soil material, wherein cutting teeth are arranged along the outer circumference of the cutting wheel in at least one circumferential row, on which at least one axial clearance adjoins, and at least one clearing plate, which is arranged to be fixed relative to the housing and engages in the at least one circumferential clearance on the cutting wheel to clear away soil material, according to the preamble of claim 1.

The invention also relates to a method for making a cut trench in the ground according to the preamble of claim 13.

A generic trench cutter is known from EP 1452645 A1, for example. Rows of cutting teeth are arranged along the circumference of the cutting wheels, which are arranged in pairs. Axial clearances remain between the rows of cutting teeth, in which so-called clearing plates engage. Here, the clearing plates are arranged on the lower face of the box-shaped housing and are used to strip off any cohesive soil material adhering to the cutting teeth, which can impair the cutting performance, and thus to keep the cutting teeth free of cohesive soil material.

In said trench cutter, the cut-out soil material remains in the ground and can be processed in situ with a supplied hardenable suspension to a so-called soil mortar. The soil mortar can form a trench wall segment after it has cured in the cut trench that has been made. A cutoff wall or enclosing wall, for example for a construction pit enclosure, can be produced from trench wall segments of this kind.

In order to produce a soil mortar in situ using the cut-out soil material, in the case of the generic trench cutter, the box-shaped housing comprising the drive unit is configured to have smaller outer peripheral dimensions than the cut trench that is formed. As a result, a clearance is produced on the housing, through which the cut-out soil material, which is mixed with the supplied curing suspension by the cutting wheels to the soil mortar, has the opportunity to flow past the housing into an upper region of the cut trench.

During operation of the trench cutter, the cutting wheels are, in particular driven in opposite directions, such that the two pairs of cutting wheels each rotate inwards and thus convey soil material into a central region below the housing of the cutter. The hardenable suspension can also be supplied in this region, in order to bring about a good mixing effect for forming the soil mortar.

When driving the cutting wheels to rotate inwards in this way, for certain types of soil, in particular soil layers containing stone material, the cut small material can be prevented from being conveyed past the housing by the clearing plates that engage in a meshing manner between the cutting teeth, for example when coarser hard stone material is present. In certain cases, this can result in an undesired excessive increase in the rotational resistance on the cutting wheels, and therefore in an increased power demand. This can also cause damage to the clearing plates and the cutting teeth.

The problem addressed by the invention is to specify a trench cutter and a method for making a cut trench which allow for particularly efficient operation when making a cut trench.

The problem is solved by a trench cutter having the features of claim 1 on the one hand and by a method having the features of claim 14 on the other hand. Preferred embodiments of the invention are set out in the dependent claims.

The trench cutter according to the invention is characterised in that the at least one clearing plate is mounted on a plate holder, so as to be spaced apart from the housing, wherein a passage is formed between the at least one clearing plate and the housing, through which passage along soil material that has been cut out during operation can be guided upwards.

A basic concept of the invention is to not arrange the clearing plates directly on the lower face of the box-shaped housing, but to arrange them on plate holders at a spacing from the box-shaped housing. In this case, the plate holders are arranged and configured such that the at least one clearing plate is arranged at a spacing from the housing, by means of which a passage for the cut-out soil material is formed. In particular, when the cutting wheels are driven to rotate inwards, cut-out soil material, optionally together with supplied suspension, can be guided past the clearing plates through this passage and can thus flow upwards in a simplified manner. The hard stone material therefore does not need to be forced through the intermeshing arrangement between the cutting teeth and the clearing plates. In addition, the actual clearing effect of the clearing plates is still maintained if soil material is adhered thereto. In a horizontal longitudinal direction, the passage can have a size of a few centimetres up to approx. 40% of a cutting diameter and, in the horizontal width direction, can have a size up to the wheel width of a cutting wheel.

A preferred embodiment of the invention resides in that at least two circumferential rows of cutting teeth are arranged on the at least one cutting wheel, which teeth are axially spaced apart from one another by a circumferential clearance, in which a clearing plate engages. In particular, more than two circumferential rows, in particular four or five circumferential rows, each having a corresponding axial spacing from the adjacent row of teeth can be arranged on the cutting wheel. In accordance with the existing clearances, which have an axial width of generally 2 to 10 cm, the clearing plates that are fixed relative to the housing in the circumferential clearances cutting teeth driven in rotation with the cutting wheel. The clearing plates can come into slight contact with, i.e. scrape against, the cutting teeth and tooth holders that pass by, or are spaced apart therefrom at a low axial spacing, for example of a few millimetres.

According to another embodiment of the invention, it is preferable that the at least one cutting wheel is mounted on a planar bearing plate on the lower face of the housing and that the at least one clearing plate together with the plate holder is mounted on the bearing plate. A drive apparatus can, in particular be provided in the bearing plate for driving the cutting wheels. In this case, the plate holder can be a simple support arm, on which the clearing plates are mounted. The support arm can be arranged to be directed transversely to the central plane of the bearing plate here. In principle, however, an L-shaped or T-shaped plate holder can be mounted on a side edge of the bearing plate or on the housing.

It is also particularly preferred for two pairs of cutting wheels to be arranged on a lower face of the housing. Each cutting wheel of a pair of cutting wheels is arranged on one side respectively of a shared central bearing plate. Here, the plate holders are arranged on the relevant outer side, such that the clearing plates can engage in the circumferential clearances between the cutting teeth, so as to be directed obliquely from the outside inwards.

Furthermore, it is particularly expedient here that, of each pair of cutting wheels, one cutting wheel is mounted on one side of the bearing plate and that at least one clearing plate, which is mounted on the bearing plate by means of a plate holder, is assigned to each cutting wheel. Preferably, a plurality of clearing plates for each cutting wheel can be provided on each plate holder corresponding to the number of clearances or gaps between the circumferential rows of the cutting teeth.

According to another configuration of the invention, it is advantageous that a passage, which is delimited by the housing, the bearing plate and the assigned at least one clearing plate together with the plate holder, is assigned to each cutting wheel. This arrangement, in particular allows harder stone material to avoid being forced through between the cutting teeth by the tooth holders and the clearing plates because the corresponding stone material can be carried away upwards through the passage.

According to a continuing formation of the trench cutter according to the invention, it is provided that a supply apparatus for supplying a liquid, in particular a curable suspension, such as a cement suspension, is arranged. In this case, the suspension can be conveyed to the trench cutter in the cut trench from above ground at a corresponding pump apparatus.

According to a continuing formation of the invention, it is particularly expedient that the supply apparatus is arranged between two pairs of cutting wheels and/or in at least one of the plate holders. In this case, as is known per se, the supply apparatus can be arranged on the lower face of the box-shaped housing in a central region between the two pairs of cutting wheels. Alternatively or additionally, the supply apparatus can also be arranged on the at least one plate holder. Here, the plate holder is configured to be hollow at least in part, with a supply duct. The supply duct ends in one or more outlet nozzles for the liquid to flow out in the region of the clearing plates. As a result, a mixing effect can be improved and, at the same time, cohesive material can additionally be flowed free at the cutting teeth.

In principle, the inventive arrangement of the clearing plates by means of plate holders can be used on various types of trench cutters. According to an embodiment of the invention, it is particularly advantageous that an outer circumference of the housing is smaller than a cutting cross section of the cutting wheels. As a result, one or more regions are formed along the housing which form a passage region or passage duct between the housing and the surrounding wall of soil. This makes it possible for cut-out soil material, and in particular soil mortar produced by supplying a hardenable liquid, to flow out of the region of the cutting wheels, past the housing of the cutting frame, upwards into a portion of the cut trench made above the housing of the trench cutter.

In principle, the trench cutter according to the invention can be driven in any suitable manner. According to a preferred embodiment of the invention, it is provided that a drive apparatus, in particular a hydraulic motor or an electric motor, is arranged in the housing for driving the cutting wheels. It can like that one or more central drive motors be provided in the housing. In this case, as is known per se, torque can be transmitted via a drive shaft extending downwards in the bearing plate and a corresponding transmission in the bearing plate or on the cutting wheels.

According to another embodiment variant of the invention, it can be advantageous that the at least one cutting wheel comprises a hub, in which a hub motor is arranged. Here, the hub motor can likewise be a hydraulic motor or preferably an electric motor. In an arrangement of this kind, the box-shaped housing can be used to receive other components or can be configured to be accordingly reduced in size. A structure of the housing which is frame-like in principle is also possible.

Another preferred embodiment of the invention resides in that the at least one clearing plate and/or the plate holder are detachably fastened and a connecting system, by means of which the at least one clearing plate can be directly fastened to the housing, is provided on the lower face of the housing. Depending on a desired type of cutting, by way of a different drive direction of the cutting wheels a particularly flexible arrangement of the clearing plates can thus be achieved. In particular, where necessary, some or all of the extern clearing plates arranged on the plate holder can be removed. Alternatively or additionally, as is known per se, clearing plates can be mounted directly on the lower face of the housing. Screw connections or other easily detachable types of connection are, in particular possible as the connecting system.

The invention also comprises a trench cutter device comprising carrier equipment, on which the trench cutter according to the invention is arranged to be vertically movable by a lifting apparatus. The carrier equipment can, in particular be configured to be movable by means of a undercarriage, in particular a caterpillar chassis, and a upper-carriage that is rotatably mounted thereon. A mast or a jib can be provided on the upper-carriage. A suspended cable or a rigid guide rod, which is movably guided along the mast, can be used as the lifting apparatus.

The method according to the invention for making a cut trench in the ground is characterised in that a trench cutter according to the invention or a trench cutter device according to the invention is used. An above-described trench cutter or an above-described trench cutter device can be used here. The above-described advantages can be achieved thereby when carrying out the method.

According to the invention, a preferred method variant resides in that the at least one cutting wheel is driven in rotation in a rotational direction, in which cut-out soil material is guided through the passage between the housing and the clearing plate by the at least one clearing plate. In particular, when cutting soil layers containing harder stone inclusions, increasing of the rotational resistance and occurring of damage can be prevented, circumstances which could arise from harder stone material being forced through between the clearing plates and the cutting teeth.

Figure 2:
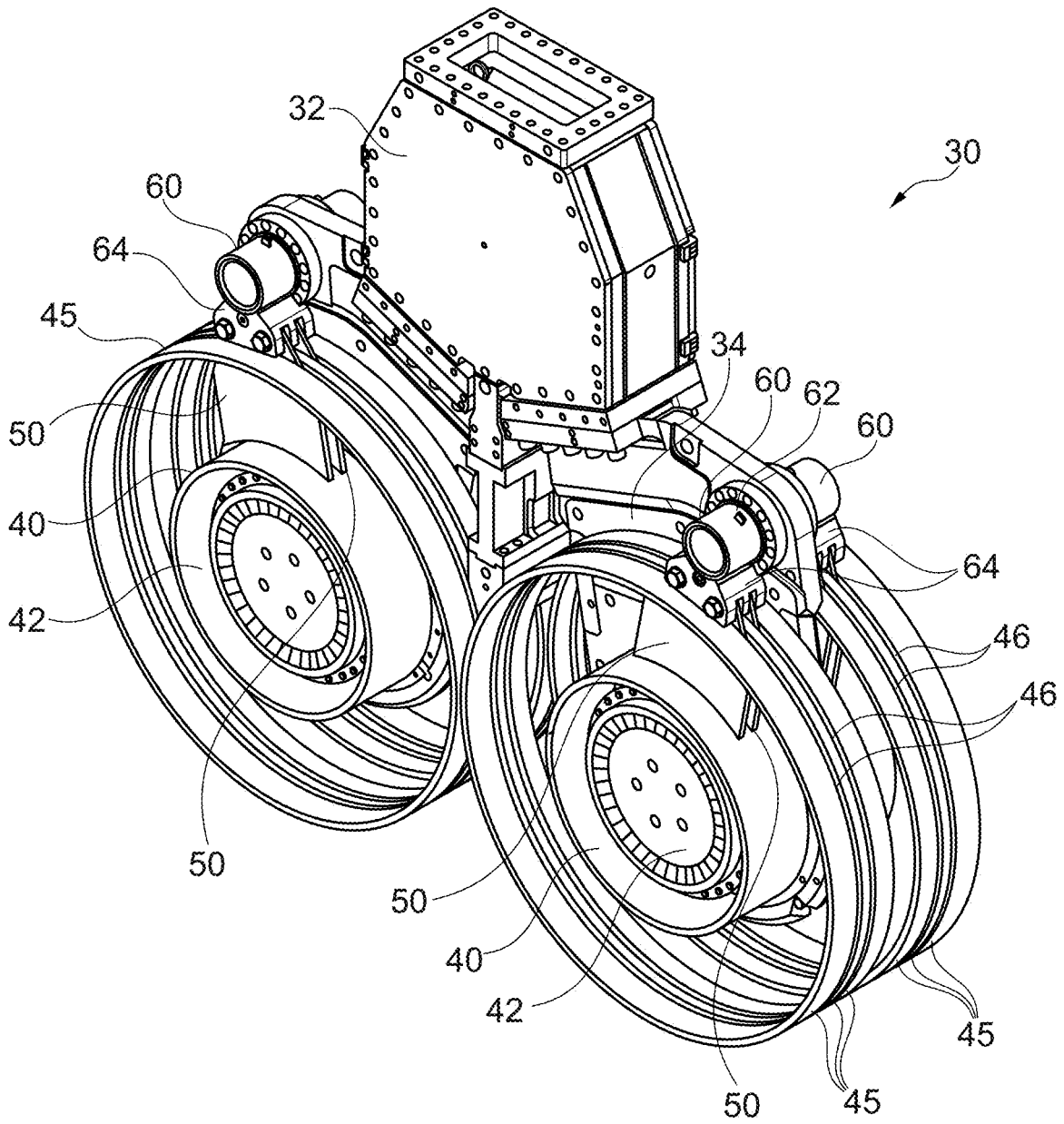
Figure 3:
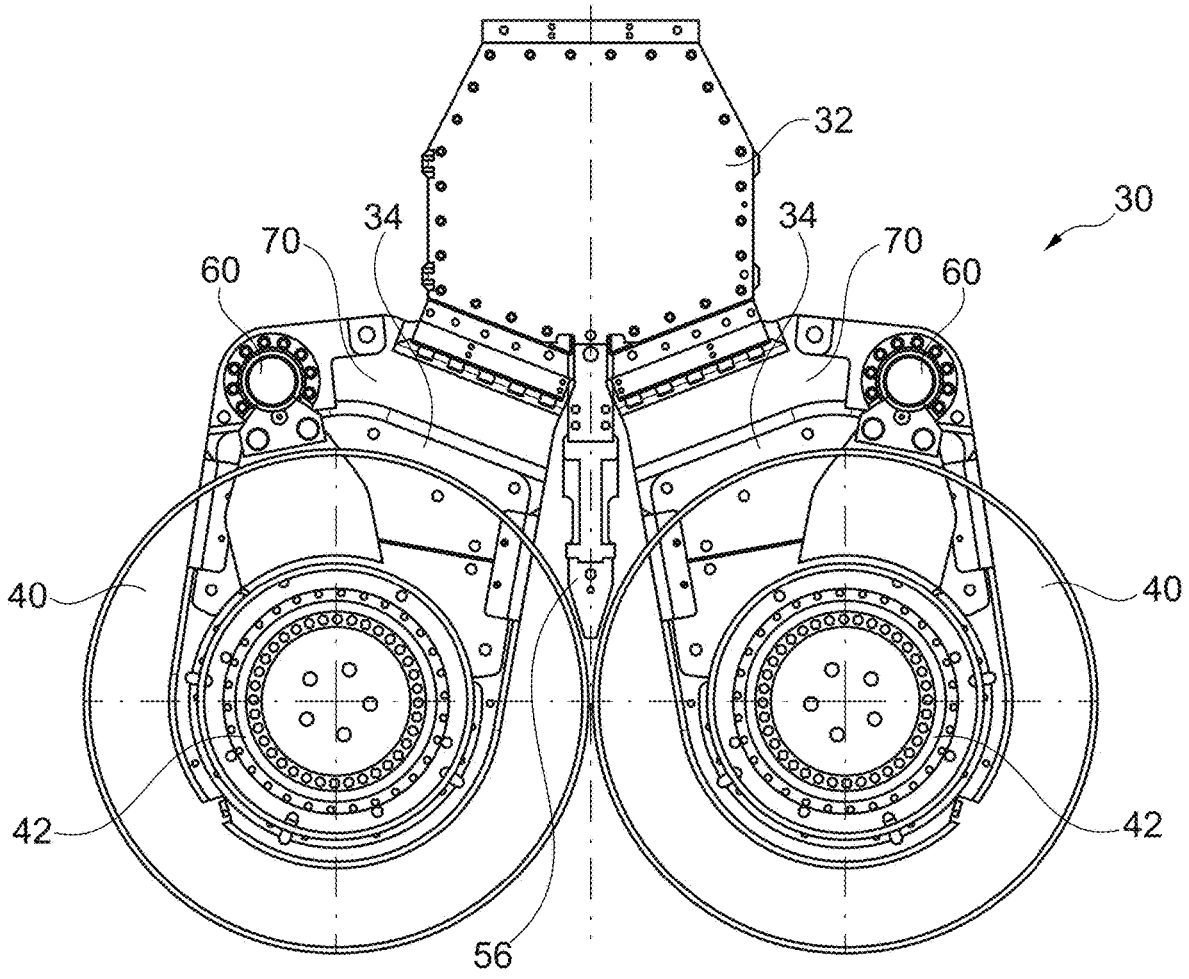
Figure 4:
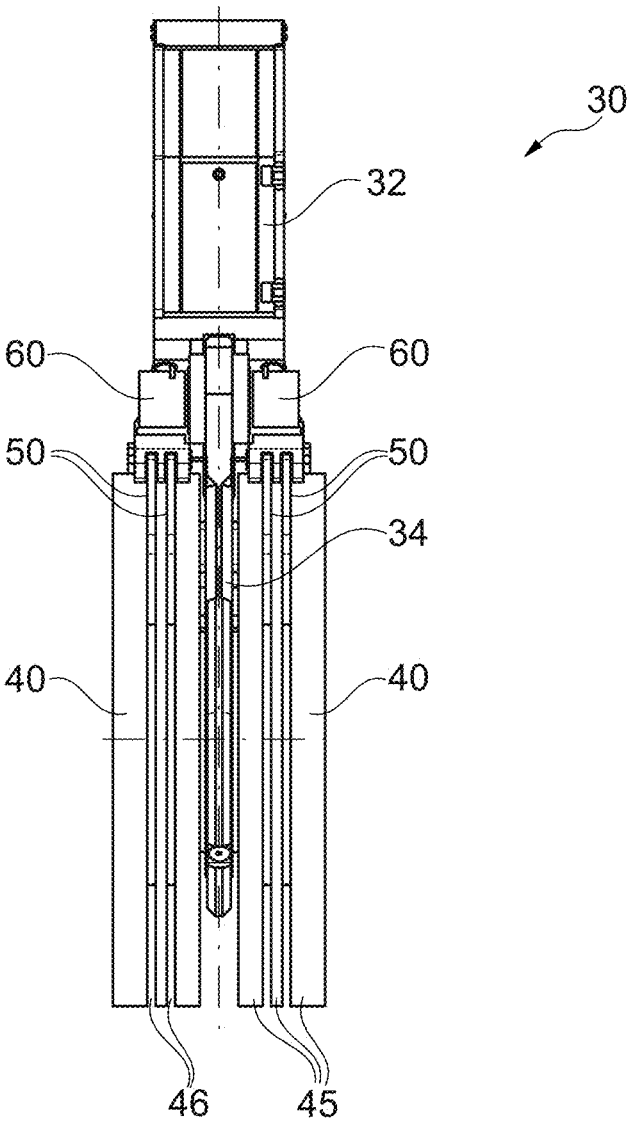
Figure 5:
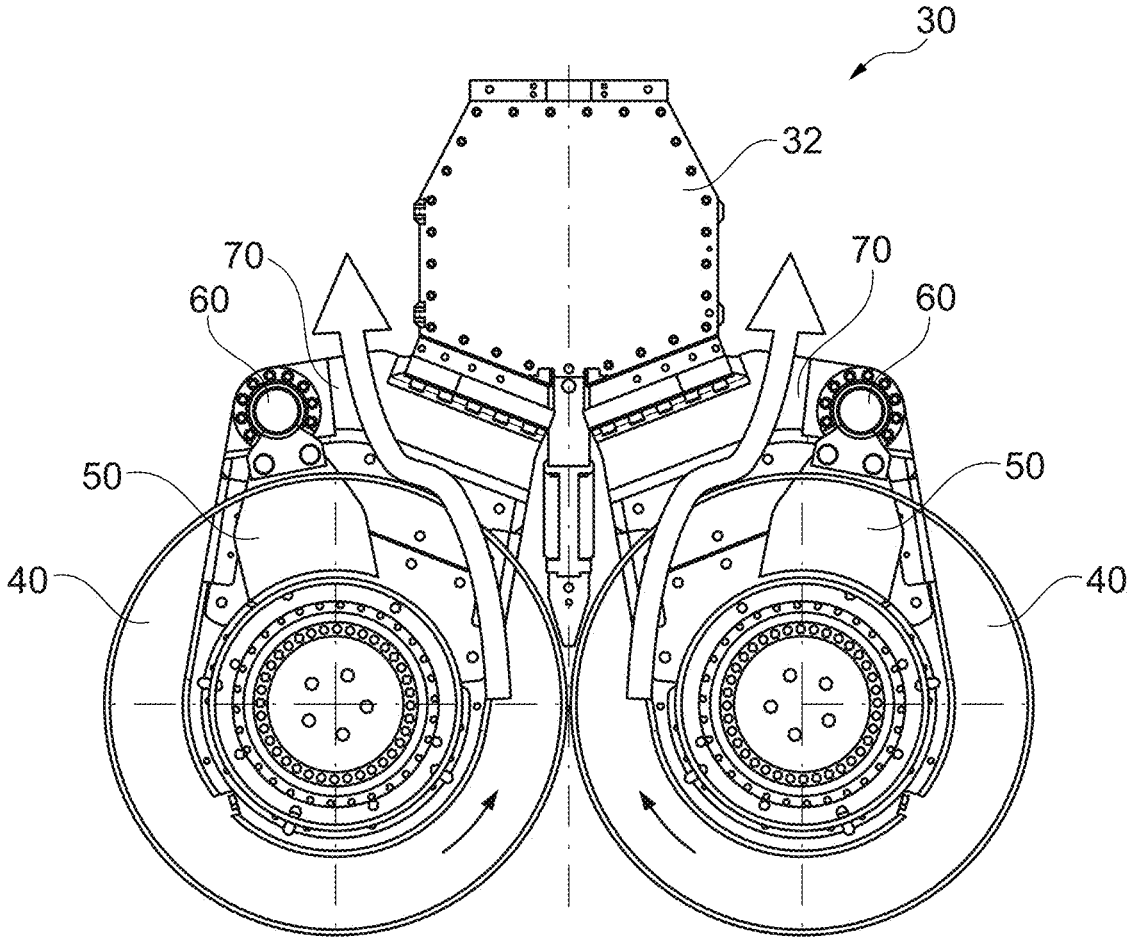

The invention is described in greater detail in the following with reference to preferred exemplary embodiments, which are shown schematically in the drawings, in which show:

FIG. 1 a perspective view of a trench cutter device according to the invention;

FIG. 2 a perspective, enlarged and schematic view of a trench cutter device according to the invention;

FIG. 3 a front view of the trench cutter according to FIG. 2;

FIG. 4 a side view of the trench cutter according to FIGS. 2 and 3; and FIG. 5 a schematic representation of the material flow during cutting using a trench cutter according to the invention.

FIG. 1 shows a trench cutter device 10 according to the invention comprising carrier equipment 12. The carrier equipment 12 can comprise a undercarriage 14 configured as a caterpillar chassis, on which an uppercarriage 16 can be rotatably mounted. A substantially vertical mast 18 can be adjustably mounted on the upper-carriage 18 by means of an articulated mechanism 17 comprising actuating cylinders. A guide rod 22 can extend along the mast 18 as part of a lifting apparatus 20. A trench cutter 30 according to the invention is mounted on the lower end of the guide rod 22, and this will be described in greater detail in the following. The guide rod 22 can be moved vertically along the mast 18 by means of movable slides 24, which can be connected to the guide rod 22 by means of moveable and by means of tensioning cylinders, as part of the lifting apparatus 20.

The trench cutter 30 shown in FIG. 1 comprises two pairs of cutting wheels 40, which are arranged in parallel with one another with rotational axes arranged horizontally. As is known per se, indicated cutting teeth 44 are mounted on the outer circumference of the cutting wheels 40.

The structure of a possible trench cutter 30 according to the invention is explained in greater detail in conjunction with FIGS. 2 to 4 by way of example. The trench cutter 30 is shown highly schematically, wherein, in particular, cutting teeth are not shown in detail for reasons of clarity, but instead annular tracks 45 or circumferential rows, along which the cutting teeth of one circumferential row on the circumference of a cutting wheel 40 move when driven in rotation. Here, the cutting teeth can be arranged on planar cutting tooth holders (not shown either), and thus can be connected to a cylindrical hub 42 of the cutting wheel 40. A hub motor for driving the cutting wheel 40 in rotation can be arranged in the interior of the hub 42.

The tracks 45 or circumferential rows of cutting teeth are axially spaced apart from one another on each cutting wheel 40, wherein a circumferential clearance 46 remains therebetween. In the exemplary embodiment shown, three circumferential tracks 45 or circumferential rows having two circumferential clearances 46 lying therebetween are provided on each cutting wheel 40. A clearing plate 50, each of which can reach close to the outer circumference of the central hub 42, can engage in these circumferential clearances 46 in each case. Here, the clearing plates 50 are mounted on a plate holder 60 on its outer side radially outside the tracks 45 of the cutting teeth and are fixed relative to the rotating cutting wheel 40. A plate holder 60 can be provided for each cutting wheel 40.

Each pair of cutting wheels 40 can be mounted on a planar bearing plate 34 that is located between the cutting wheels 40 and is mounted on a lower face of a box-shaped housing 32 in each case. The respective plate holders 60 for the clearing plates 50 can also be mounted on the bearing plate 34 for each pair of cutting wheels 40. In the exemplary embodiment shown, the plate holders 60 comprise a holding shaft 62 flanged to the bearing plate 34. A holding bracket 64, to which the clearing plates 50 for each cutting wheel 50 can preferably be detachably fastened by means of screw connections, can be fastened to the holding shaft 62.

The plate holders 60, which preferably extend substantially in parallel with the rotational axes of the cutting wheels 40, are arranged according to the invention to be spaced apart from the box-shaped housing 32 of the trench cutter 30 such that a clearance or passage 70 is formed between the respectively plate holder 60 and the housing 32, as shown in FIG. 3, for example.

A first supply apparatus 56 for supplying a hardenable suspension into the region between the cutting wheels 40 can be provided on the lower face of the housing 32 centrally between the two planar bearing plates 34. Alternatively or additionally, one or more supply apparatuses can be provided in tubular designed holding shafts 62.

The cutting wheels 40 can be driven in rotation such that they each rotate inwards by means of a drive apparatus (not shown in greater detail), which, in the exemplary embodiment shown, can, in particular be hub motors in the hubs 42 of the cutting wheels 40. This is indicated by arrows indicating the rotational direction in the view in FIG. 5.

When the cutting wheels 40 are driven in this way according to FIG. 5, when soil material is removed during the cutting operation, this soil material can be mixed with supplied hardenable suspension in the central region between the cutting wheels 40 to a soil mortar. In this process, the removed soil material and the soil mortar produced can thus flow upwards through the respectively formed passage 70 owing to the arrangement of the clearing plates 50 on the plate holders 60 spaced apart from the housing 32, as schematically indicated by the flow arrows in FIG. 5. In this case, the peripheral dimensions of the box-shaped housing 32 are smaller dimensioned than a cutting cross section produced by the cutting wheels 40.

In this case, the outer edges of the clearing plates 50 can be configured to be accordingly inwardly inclined, such that an upward flow of the cut-out soil material and suspension through the passage 70 between the plate holder 60 and the housing 32 is assisted. As a result, in particular when cutting through rocky or stony soil layers, larger pieces of rock can also be efficiently discharged out of the region of the cutting wheels 40 upwards past the housing 32, meaning that the risk of damage to the clearing plates 50 and cutting teeth is reduced.

The invention claimed is:

1. A trench cutter comprising a box-shaped housing having an upper face configured to mount a lifting apparatus, at least one cutting wheel, which is arranged below a lower face of the housing and is configured to be driven in rotation to remove soil material, wherein cutting teeth are arranged along the outer circumference of the cutting wheel in at least one circumferential row, which at least one axial circumferential clearance adjoins, at least one clearing plate, which is arranged to be fixed relative to the housing and engages in the at least one circumferential clearance on the cutting wheel to clear away soil material, wherein the at least one cutting wheel is mounted on a major surface of a planar bearing plate below the lower face of the housing, wherein the major surface of the bearing plate is perpendicular to and intersects a rotation axis of the cutting wheel, and is parallel to the cutting wheel, the at least one clearing plate is mounted on a plate holder, and the plate holder is mounted directly to the major surface of the bearing plate, the at least one clearing plate is mounted on the plate holder so as to be spaced apart from the housing, and the plate holder is mounted on the bearing plate so as to be spaced apart from the housing, when viewed in a direction of the rotation axis of the cutting wheel, the clearing plate and the plate holder do not overlap with the housing, and a passage is formed between the at least one clearing plate, the plate holder, and the housing, through which passage soil material that has been cut out during operation is guided upwards.

2. The trench cutter according to claim 1, wherein at least two circumferential rows of cutting teeth are arranged on the at least one cutting wheel, which teeth are axially spaced apart from one another by a circumferential clearance, in which a clearing plate engages.

3. The trench cutter according to claim 1,
wherein
two pairs of cutting wheels are arranged on the lower face of the housing.

4. The trench cutter according to claim 3,
wherein
from of each pair of cutting wheels, one cutting wheel is mounted on one side of the bearing plate and
at least one clearing plate, which is mounted on the bearing plate by means of a plate holder, is assigned to each cutting wheel.

5. The trench cutter according to claim 4,
wherein
one of the passage, which is delimited by the housing, the bearing plate and the assigned at least one clearing plate with the plate holder, is assigned to each cutting wheel.

6. The trench cutter according to claim 1,
wherein
a supply system for supplying a liquid, in particular a curable suspension, is arranged.

7. The trench cutter according to claim 6,
wherein
the supply system is arranged between two pairs of cutting wheels and/or in at least one of the plate holders.

8. The trench cutter according to claim 1,
wherein
an outer circumference of the housing is smaller than a cutting cross section of the cutting wheels.

9. The trench cutter according to claim 1,
wherein
a drive apparatus, in particular a hydraulic motor or an electric motor, is arranged in the housing for driving the cutting wheels.

10. The trench cutter according to claim 1,
wherein
the at least one cutting wheel comprises a hub, in which a hub motor is arranged.

11. The trench cutter according to claim 1,
wherein
the at least one clearing plate and/or the plate holder are detachably fastened and a connecting system for at least one clearing plate is provided on the lower face of the housing.

12. A trench cutter device comprising: carrier equipment, on which the trench cutter according to claim 1 is arranged to be vertically movable by the lifting apparatus.

13. A method for making a cut trench in the ground, the method comprising:
utilizing the trench cutter according to claim 1.

14. The method according to claim 13, comprising:
driving the at least one cutting wheel in rotation in a rotational direction, and guiding cut-out soil material through the passage between the housing and the clearing plate using the at least one clearing plate.

15. A method for making a cut trench in the ground, the method comprising:
utilizing the trench cutter device according to claim 12.

* * * * *